US006645922B2

(12) United States Patent
Dunn et al.

(10) Patent No.: US 6,645,922 B2
(45) Date of Patent: Nov. 11, 2003

(54) LUBRICATION

(75) Inventors: Adrian Dunn, Uffington Faringdon (GB); Laurent Chambard, Stanford-in-the-Vale Faringdon (GB); Yolanda Owen, Charlton Wantage (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/055,081

(22) Filed: Jan. 23, 2002

(65) Prior Publication Data

US 2002/0155958 A1 Oct. 24, 2002

(30) Foreign Application Priority Data

Feb. 6, 2001 (EP) ..... 01301055

(51) Int. Cl.[7] ..... C10M 159/20

(52) U.S. Cl. ..... 508/398; 508/391; 508/460; 508/574

(58) Field of Search ..... 508/460, 398, 508/391, 574

(56) References Cited

U.S. PATENT DOCUMENTS

| | | | | | |
|---|---|---|---|---|---|
| 5,433,871 | A | | 7/1995 | O'Connor et al. | 252/18 |
| 5,808,145 | A | * | 9/1998 | Le Coent et al. | 508/525 |
| 6,001,785 | A | * | 12/1999 | Le Coent et al. | 508/460 |
| 6,034,039 | A | * | 3/2000 | Gomes et al. | 508/331 |
| 6,153,565 | A | * | 11/2000 | Skinner et al. | 508/391 |
| 6,162,769 | A | * | 12/2000 | Polhaar et al. | 508/339 |
| 6,277,794 | B1 | * | 8/2001 | Dunn | 508/199 |
| 6,281,179 | B1 | * | 8/2001 | Skinner et al. | 510/184 |

FOREIGN PATENT DOCUMENTS

| | | | |
|---|---|---|---|
| EP | 1046698 A1 | 10/2000 | C10M/163/00 |
| GB | 729376 | 5/1955 | |
| WO | WO99/35218 | 7/1999 | C10M/163/00 |

* cited by examiner

*Primary Examiner*—Jacqueline V. Howard

(57) ABSTRACT

A lubricating oil composition suitable for a two-stroke cross-head marine diesel engine. The lubricating oil composition comprises a base oil and an oil-soluble overbased metal detergent additive in the form of a complex wherein the basic material of the detergent is stabilized by more than one surfactant.

11 Claims, No Drawings

LUBRICATION

This invention concerns a lubricating oil composition suitable for use in a two-stroke cross-head marine diesel (compression-ignited) engine. The lubricating oil composition comprises a base oil and a metal detergent additive.

One type of marine diesel propulsion engine is characterised as a slow speed, two-stroke engine which is frequently referred to as a cross-head engine because of its construction. The firing cylinder and crankcase are lubricated separately by cylinder and system oils respectively. The cylinder oil, sometimes referred to as a marine diesel cylinder lubricant (MDCL), is fed to the internal walls of the cylinder by injection and, unlike the system or crankcase oil, is consumed. This invention is concerned with lubrication of the crankcase, bearings and, gears and valve-train system (if required), or system lubrication.

A paper entitled "Cylinder and System Lubricating Oil Qualities and New Engine Development" made public by MAN B & W, a leading manufacturer of cross-head marine diesel engines, in November 2000, reports recent developments in the design of such engines as requiring original equipment manufacturer (OEM's) to improve the efficiency of the oil-cooling of the pistons. The system oil performs such oil-cooling and is required to control piston temperatures which tend to rise due to the higher engine loads that are being imposed.

Improved cooling-efficiency requires the oil to dispose of more heat thereby placing new demands on it in terms of oxidation and high temperature deposit control. The above paper recognises that some commercial system oils fail to meet these demands.

The present invention ameliorates the above problem by providing the detergency for system oils by use of a complex detergent rather than non-complex detergents as known in the art. The examples of this specification show a remarkable and surprising improvement when using a complex detergent.

Accordingly, a first aspect of the invention is a lubricating oil composition suitable for a two-stroke cross-head marine compression ignited (diesel) engine system, the lubricating oil composition comprising:

(A) a base stock of lubricating viscosity, in a major amount; and (B) an oil-soluble overbased metal detergent additive, in a minor amount, in the form of a complex wherein the basic material of the detergent is stabilised by more than one surfactant.

A second aspect of the present invention is a method of providing system lubrication to a two-stroke cross-head marine compression ignited (diesel) engine which comprises lubricating the crankcase of the engine with the lubricating oil composition as defined in the first aspect of the invention.

A third aspect of the present invention is a combination of the crankcase of a two-stroke cross-head marine compression-ignited (diesel) engine and the lubricating oil composition as defined in the first aspect of the invention.

A fourth aspect of the present invention is a method of improving the oxidation control of a two-stroke cross-head marine compression-ignited (diesel) engine system lubricant which comprises using, as a detergent in the lubricant, a detergent as defined in the first aspect of the invention.

In this specification, the following words and expressions shall have the meanings ascribed below:

"major amount"—in excess of 50 mass % of the lubricant, preferably in excess of 60 mass %, more preferably in excess of 70 mass %;

"minor amount"—less that 50 mass % of the lubricant, both in respect of the stated additive and in respect of the total mass % of all the additives present in the lubricant, reckoned as active ingredient of the additive or additives; preferably less than 40 mass %, more preferably less than 30 mass %;

"active ingredient (a.i.)" refers to additive material that is not diluent;

"comprises or comprising, or cognate words"—specifies the presence of stated features, steps, integers or components, but does not preclude the presence or addition of one or more other features, steps, integers, components, or groups thereof;

"TBN"—Total Base Numbers as measured by ASTM D2896;

"oil-soluble or oil-dispersible"—do not necessarily indicate solubility, dissolvability, miscibility or capability of suppression in oil in all proportions. They do mean, however, solubility or stable dispersibility sufficient to exert the intended effect in the environment in which the oil is employed. Moreover, additional incorporation of other additives may permit incorporation of higher levels of a particular additive, if desired.

It will be understood that the various components of the lubricating oil composition, essential as well as optimal and customary, may react under the conditions of formulation, storage or use and that the invention also provides the product obtainable or obtained as a result of any such reaction.

The features of the invention will now be discussed in more detail as follows:

Two-Stroke Cross-Head Marine Diesel Engine

The engines may, for example, have from 6 to 12 cylinders and their engine speed may, for example, be in the range of from 40 to 200, preferably 60 to 120, rpm. Their total output may, for example, be in the range of 18,000 to 70,000 kW.

Lubricating Oil Composition

The lubricating oil composition may, for example, have a TBN of 2 or greater, preferably, 5 or greater; more preferably in the range of from 2 to 8, preferably 5 to 8. Such lubricating oil compositions because they are rarely, if ever, changed, need to be resilient and may be characterised by superior or particular strength against wear, corrosion, oxidation, and water centrifugation.

The lubricating oil composition may, for example, have a kinematic viscosity at 100° C. (as measured by ASTM D445) of at least 10, preferably at least 11, more preferably in the range from 10 to 12. The lubricants are usually SAE30 oils.

(A) Base Stock (Base Oil) of Lubricating Viscosity

The base stock is an oil of lubricating viscosity (sometimes referred to as base oil) and may be any oil suitable for the system lubrication of a cross-head engine. The lubricating oil may suitably be an animal, vegetable or a mineral oil. Suitably the lubricating oil is a petroleum derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example, liquid polyisobutene and poly-alpha olefins. Commonly, a mineral oil is employed. The lubricating oil may generally comprise greater than 60, typically greater than 70, % by mass of the lubricating oil composition and typically have a kinematic viscosity at 100° C. of from 2 to 40, for example from 3 to 15, $mm^2s^{-1}$, and a viscosity index from 80 to 100, for example from 90 to 95.

Another class of lubricating oil is hydrocracked oils, where the refining process further breaks down the middle and heavy distillate fractions in the presence of hydrogen at high temperatures and moderate pressures. Hydrocracked oils typically have kinematic viscosity at 100° C. of from 2 to 40, for example from 3 to 15, $mm^2s^{-1}$ and a viscosity index typically in the range of from 100 to 110, for example from 105 to 108.

The term 'brightstock' as used herein refers to base oils which are solvent-extracted, de-asphalted products from vacuum residuum generally having a kinematic viscosity at 100° C. from 28 to 36 $mm^2s^{-1}$ and are typically used in a proportion of less that 30, preferably less than 20, more preferably less than 15, most preferably less than 10, such as less than 5, mass %, based on the mass of the lubricating oil composition.

(B) Complex Overbased Metal Detergent

A detergent is an additive that reduces formation of piston deposits, for example, high-temperature varnish and lacquer deposits, in engines; it has acid-neutralising properties and is capable of keeping finely divided solids in suspension. It is based on metal "soaps", that is metal salts of acidic organic compounds, sometimes referred to as surfactants.

The detergent comprises a polar head with a long hydrophobic tail, the polar head comprises a metal salt of the acid in compound. Large amounts of a metal base are included by reacting an excess of a metal compound, such as an oxide or hydroxide, with an acidic gas such as carbon dioxide to give an overbased detergent which comprises neutralised detergent as the outer layer of a metal detergent which comprises neutralised detergent as the outer layer of a metal base (e.g. carbonate) micelle. The overbased detergents of this invention may have a TBN in the range of 100 to 500, preferably 150 to 400.

As stated, the detergent is in the form of a complex wherein the basic material is stabilised by more than one surfactant. Thus, complexes are distinguished from mixtures of two or more separate overbased detergents, an example of such a mixture being one of an overbased salicylate detergent with an overbased phenate detergent.

The art describes examples of overbased complex detergents. For example, International Patent Application Publication Nos 97/46643/4/5/6 and 7 describe hybrid complexes made by neutralising a mixture of more than one acidic organic compound with a basic metal compound, and then overbasing. Individual basic micelles of the detergent are thus stabilised by a plurality of surfactants.

EP-A-0 750 659 describes a calcium salicylate phenate complex made by carboxylating a calcium phenate and then sulfurising and overbasing the mixture of calcium salicylate and calcium phenate. Such complexes may be referred to as "phenalates"

The metal may be an alkali or alkaline earth metal, e.g., sodium, potassium, lithium, calcium, and magnesium. Calcium is preferred.

Surfactants that may be used include organic carboxylates, such as salicylates, non-sulfurised or sulfurised; sulfonates; phenates, non-sulfurised or sulfurised; thiophosphonates; and naphthenates. For example, the surfactants may be salicylate and phenate.

The overbased complex detergent is preferably prepared by treating with an overbasing agent a mixture comprising (a), (b) and (c), wherein (a) is selected from (a1), (a2), (a3) and (a4):

(a1) at least two surfactants, at least one of which is a sulphurized or non-sulphurized phenol or a derivative thereof, and the other is other than a phenol surfactant;

(a2) at least two surfactants, at least one of which is a sulphurized or non-sulphurized salicylic acid or a derivative thereof, and the other is other than a salicylic surfactant;

(a3) at least three surfactants, at least one of which is a sulphurized or non-sulphurized phenol or derivative thereof, at least one of which is a sulphurized or non-sulphurized salicylic acid or a derivative thereof, and at least one of which is other than a phenol or salicylic surfactant;

(a4) at least three surfactants, at least one of which is a sulphurized or non-sulphurized phenol or derivative thereof, at least one of which is a sulphurized or non-sulphurized salicylic acid or derivative thereof, and at least one of which is a sulphonic acid or derivative thereof;

(b) at least one basic calcium compound; and (c) oil, treatment with the overbasing agent being carried out in at least one step, preferably at least two steps, at less than 100° C., preferably at a temperature between 25 and 50° C. The process is preferably such that:

when the starting materials include (a1), the proportion, measured as described in WO 97/46643, of the phenol in the surfactant system of the overbased detergent is at least 45 mass %, and the overbased detergent has a TBN:% surfactant ratio (as defined in WO 97/46643) of at least 14, advantageously at least 15, especially at least 19, provided that, when said ratio is less than 15, the said proportion of phenol is at least 60 mass %, and when the ratio is less than 19 and the proportion of phenol is less than 60 mass %, the overbased detergent has a viscosity at 100° C. of at most 1000 $mm^2/s$;

when the starting materials include (a2), the proportion, measured as described in WO 97/46643, of the salicylic acid in the surfactant system of the overbased detergent is at least 25 mass %, and the overbased detergent has a TBN:% surfactant ratio (as defined in WO 97/46643) of at least 16;

when the starting materials include (a3), the proportion, as measured in WO 97/46643, of the said phenol in the surfactant system of the overbased detergent is at least 35 mass %, and the overbased detergent has a TBN:% of surfactant ratio (as defined in WO 97/46643) of at least 11, preferably at least 12; and when the starting materials include (a4), the overbased detergent has a TBN of at least 300.

Suitable overbasing agents are carbon dioxide, a source of boron, for example boric acid, sulphur dioxide, hydrogen sulphide and ammonia. The most preferred overbasing agent is carbon dioxide and, for convenience, the treatment with overbasing agent will in general be referred to as 'carbonation'. Preferably carbonation is carried out at atmospheric pressure.

Advantageously, at least one carbonation step is followed by a 'heat-soaking' step in which the mixture is maintained, without addition of any further chemical reagents, in a selected temperature range for a period before any further processing steps are carried out. Preferably, heat-soaking is carried out for at least 60 minutes. Preferably the heat-soaking is carried out at a temperature between 26 and 60° C. (the temperature should be such that substantially no materials are removed from the system during the heat-soaking). Heat-soaking has the effect of assisting product stabilization, dissolution of solids and filtrability.

Preferably the overbased complex detergent is prepared using two carbonation steps, each one of which is followed by a heat-soaking step.

Basic calcium compounds include calcium oxide, hydroxide, alkoxides and carboxylates. Calcium oxide and calcium hydroxide are preferred.

Suitable solvents include aromatic solvents such as benzene, alkyl-substituted benzenes such as toluene or xylene, halogen-substituted benzenes and lower alcohols.

Suitable promoters for the process include methanol, toluene and water. If desired, low molecular weight carboxylic acids (with 1 to 7 carbon atoms), for example formic acid, inorganic halides or ammonium compounds may be used to facilitate carbonation, to improve filterability or as viscosity agents for overbased detergents.

The overbased complex detergents preferably have a TBN of at least 300, preferably at least 330, preferably at least 350, more preferably at least 400 and especially at least 450.

Surfactants for the surfactant system of the overbased complex metal detergent may contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impact the desired oil-solubility.

The complex detergent may be used in a proportion in the range of 0.1 to 30, preferably 2 to 15 or to 20, mass % based on the mass of the lubricating oil composition.

Other additives, such as known in the art, may be incorporated into the lubricating oil compositions of the invention. They may, for example, include other overbased metal detergents that are not complex detergents, for example alkaline earth metal (eg Ca or Mg) phenates or salicylates; ashless dispersants; anti-wear agents; anti-oxidants; pour point depressants; anti-foamants; and/or demulsifiers.

It may be desirable, although not essential, to prepare one or more additive packages or concentrates comprising the additive or additives, whereby the additives can be added simultaneously to the oil of lubricating viscosity (or base oil) to form the lubricant. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricant. Thus, additives may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations may typically contain about 2 to 40, such as 2 to 20, mass % of the additive packages(s), the remainder being base oil.

EXAMPLES

The following examples illustrate, but in no way limit, the invention.

Components

The components used in the examples were as follows (A) Basestock

A conventional mineral oil basestock of lubricating viscosity.

(B) Complex Metal Detergent

A calcium phenate/salicylate/sulfonate hybrid complex having a TBN of 350 made by overbasing a mixture of a salicylic acid, a phenol and a sulfonic acid and a basic calcium compound, eg as described in International Patent Application Publication Nos 9746643/4/5/6 and 7.

Other Detergents

C1—a calcium phenate having a TBN of 258.

C2—a calcium phenate having a TBN of 135.

C3—a calcium sulfonate having a TBN of 300.

C4—a calcium salicylate having a TBN of 168.

C5—a calcium salicylate having a TBN of 280.

Lubricating Oil Compositions, Tests and Results

Lubricating oil compositions, as two-stroke cross-head marine diesel engine system lubricants, were prepared by admixing with a base stock (A) one or more of the detergents B and C1 to C5. Also admixed were one or more of ashless dispersants, anti-wear agents, anti-oxidants, anti-foamants, anti-rust agents and demulsifiers.

The admixing was carried out at elevated temperature:

four lubricants were prepared for testing, of which three (Lubricant 1, 2 and 3) were lubricants of the invention and the other (Reference Lubricant 1) was for comparison. Also obtained for testing was a commercially available marine diesel system lubricant (Reference Lubricant 2) and which contained additive components identified in these examples.

Each lubricant was tested for oxidation control according to the widely recognised Caterpillar Micro-Oxidation Test (CMOT) which was originally published by Zeria and Moore ("Evaluation of Diesel Engine Lubricants by Micro-Oxidation", SAE 890239). In summary, the test procedure is as follows:

A steel coupon with the same metallurgy as a piston of a Caterpillar 3600 engine is held at 230° C. A drop of test lubricating oil composition (20 mg) is placed on the coupon for a fixed period of time (eg 70 to 220 minutes). Deposits are determined by weighing at various residence times and per cent deposits is plotted against time. The plot is an S-shaped curve, the break of which is extrapolated back to zero per cent deposits to give the CMOT induction time, in minutes.

The results are expressed as an induction time, in minutes, wherein a higher induction time indicates a better performance. Caterpillar recognises a lubricating oil composition as 'good' when its induction time in the above test exceeds 90 minutes.

The results obtained and identification of the test lubricating oil compositions are summarised in the table below where the presence of an above-identified detergent is indicated by a tick and the indicated TBN of each test lubricant is according to ASTM D 2896.

| Lubricating Oil Composition | B | C1 | C2 | C3 | C4 | C5 | TBN | Result |
|---|---|---|---|---|---|---|---|---|
| 1 | ✓ | | | | | | 5.60 | 96.9 |
| 2 | ✓ | | | | | | 5.47 | 124.8 |
| 3 | ✓ | | | | | | 5.31 | 106.2 |
| Reference 1 | | | | | ✓ | ✓ | 9.61 | 82.7 |
| Reference 2 | | ✓ | ✓ | ✓ | | | 5.48 | 79.9* |

*average of three tests; standard deviation 2.96

Lubricant 1 contains an aminic anti-oxidant whereas Lubricants 2 and 3 lack such an anti-oxidant. Lubricants 1 and 2 contain a nonylphenol sulfide additive whereas Lubricant 3 lacks such an additive. Reference Lubricants 1 and 2 lack both aminic anti-oxidants and nonylphenol sulfide additives. Thus, the best comparison is between Lubricant 3 and Reference Lubricant 2 which have comparable TBN's and contain the same components except for the detergency provision.

The above results show, in all cases, the superiority of the lubricants of the invention, which contained a complex detergent, over the comparison lubricants, which contained a non-complex detergent. In particular, Lubricant 3 is superior to Reference Lubricant 2.

What is claimed is:

1. A system lubricating oil composition for a two-stroke cross-head marine compression ignited engine said composition having a TBN from about 2 to about 8 and comprising, or being made by admixing:

(A) a base stock of lubricating viscosity, in a major amount; and (B) an oil-soluble overbased metal detergent additive, in a minor amount, in the form of a complex wherein the basic material of the detergent is stabilised by more than one surfactant.

2. The lubricant as claimed in claim 1, wherein in (B) at least one of the surfactants is a salicylate.

3. The lubricant as claimed in claim 2, wherein in (B) another of the surfactants is a phenate.

4. The lubricating oil composition as claimed in claim 1, wherein the metal detergent is a calcium detergent.

5. The lubricating oil composition as claimed in claim 1, wherein the metal detergent (B) is a hybrid complex made by neutralising a mixture of more than one acidic organic compound, and then overbasing.

6. The lubricating oil composition as claimed in claim 1, wherein the metal detergent (B) is a calcium salicylate/phenate complex made by carboxylating a calcium phenate and then sulfurising and overbasing the mixture of calcium salicylate and calcium phenate.

7. The lubricating oil composition as claimed in claim 1, wherein the metal detergent (B) is a calcium salicylate/phenate/sulfonate complex.

8. The lubricating oil composition as claimed in claim 1, further comprising, or made by admixing, in minor amounts, one or more other overbased metal detergents; ashless dispersants; anti-wear agents; and anti-oxidants.

9. A method of providing system lubrication to a two-stroke cross-head marine compression ignited engine, which comprises lubricating the crankcase of the engine with a lubricating oil composition as claimed in claim 1.

10. A combination of the crankcase of a two-stroke cross-head marine compression-ignited engine and a lubricating oil composition as claimed in claim 1.

11. A method of improving the oxidation control of a two-stroke cross-head marine compression-ignited engine system lubricant having a TBN of from about 2 to about 8, which comprises using, as a detergent in the lubricant, an oil-soluble overbased metal detergent additive in the form of a complex wherein the basic material of the detergent is stabilised by more than one surfactant.

* * * * *